US005900569A

United States Patent [19]

Kim

[11] Patent Number: 5,900,569

[45] Date of Patent: May 4, 1999

[54] MUSIC PLAYING DATA FETCH CIRCUIT

[75] Inventor: Nak-Jung Kim, Seoul, Rep. of Korea

[73] Assignee: LG Semicon Co., Ltd., Choongcheongbuk-Do, Rep. of Korea

[21] Appl. No.: 08/953,384

[22] Filed: Oct. 17, 1997

[30] Foreign Application Priority Data

Mar. 12, 1997 [KR] Rep. of Korea ..... 97/8223

[51] Int. Cl.[6] ..... G10H 7/00

[52] U.S. Cl. ..... 84/645

[58] Field of Search ..... 84/645, 600–602

[56] References Cited

U.S. PATENT DOCUMENTS

| | | | |
|---|---|---|---|
| 4,777,857 | 10/1988 | Stewart | 84/645 |
| 5,121,491 | 6/1992 | Sloan et al. | 84/645 X |
| 5,262,580 | 11/1993 | Tanaka et al. | 84/645 X |
| 5,392,224 | 2/1995 | Badia et al. | 84/645 X |
| 5,412,666 | 5/1995 | Squires et al. . | |
| 5,581,530 | 12/1996 | Iizuka et al. . | |
| 5,797,043 | 8/1998 | Lewis et al. . | |

*Primary Examiner*—William M. Shoop, Jr.
*Assistant Examiner*—Jeffrey W. Donels

[57] ABSTRACT

A music playing data fetch circuit for a personal computer which is capable of improving a music playing operation using a CPU of a personal computer by using a 64-bit FIFO memory without using an interrupt signal. The circuit includes a sound interface controller for receiving a serial playing data from a music playing program from a central processing unit (CPU) of a personal computer (PC), a midi (musical instrument device interface) interface controller for fetching a serial playing data from the sound interface controller and generating tone, waveform, etc. by enabling an interrupt request signal, and a buffer for buffering a data from the sound interface controller when the personal computer requests the data transmitted to the midi interface controller.

9 Claims, 3 Drawing Sheets

MUSIC PLAYING DATA FETCH CIRCUIT

BACKGROUND OF THE INVENTION

1. Field of the Invention

The present invention relates to a music playing data fetch circuit for a personal computer, and in particular to an improved music playing data fetch circuit for a personal computer which is capable of reducing the operational time of an operating system of a personal computer by fetching a serial playing data of a music playing program, and reducing a chip size by transmitting and receiving a midi data by using only a receiving channel of a universal type asynchronous transceiver.

2. Discussion of Related Art

FIG. 1 illustrates a conventional sound card circuit for a personal computer using a music playing program.

As shown therein, the conventional sound card circuit includes a CODEC 10 for receiving a musical instrument device interface (MIDI) signal from a central processing unit (CPU) of a personal computer, converting the thusly received signal into a digital midi data, a tone Read Only Memory (ROM) 30 for storing a tone data, a sound Integrated Circuit (IC) 20 for generating and outputting a tone corresponding to the tone data inputted, a micro-program control unit 40 for performing a stored micro-program in accordance with a midi signal from the CODEC 10, a program ROM 50 for storing a program code which is used when performing a micro-program of the micro-program control unit 40, a random access memory (RAM) 60 for storing a data which is used for performing the micro-program, and a modulation IC 70 for generating a sound wave form which forms a sine wave form.

The operation of the conventional sound card circuit will now be explained with reference to FIG. 1.

First, when a midi signal for requesting to play "Do" in piano is inputted from the CPU of the personal computer, the CODEC 10 receives the signal, converts the signal into a digital midi data, and transmits to the micro-program control unit 40.

The micro-program control unit 40 performs a micro-program, and analyzes an inputted midi data.

A tone data corresponding to "Do" is outputted from the tone ROM 30, and a predetermined tone corresponding thereto is generated by controlling the sound IC 20, and a wave form corresponding thereto is formed by controlling the frequency modulation IC 70 and then the tone signal is transmitted to the CODEC 10.

The CODEC 10 converts the data corresponding to the tone and wave form generated by the micro-program control unit 40 into an analog signal.

The program code which is used at the time when the micro-program control unit 40 performs a microprogram is read from the program ROM 50, and the RAM 80 temporarily stores and outputs the data.

However, the conventional sound card circuit has a problem in that if each function of the system is performed by using sound card circuits, the chip size is made bulky.

In order to overcome the above-described problem, the micro-program control unit 40, the program ROM 50, the RAM 60, and the frequency modulation ID 70 are operated based on the software and the CPU of the personal computer.

Namely, since the CPU has a multi-task function for concurrently performing a music or a game such as a cake walk, it is possible to process a serial midi data based on the software.

Therefore, the CODEC 10, the sound card IC 20, and the tone ROM 30 are configured as shown in FIG. 1, and the functions of the remaining elements are performed based on the software.

However, in the conventional sound card circuit, since the serial playing data of the music playing program is fetched based on the software, the sound card circuit is operated much more dependently to the operating system of the personal computer. Therefore, there may be computer programs which are not operated under DOS, Windows 3.1, and Windows 95. In addition, the software should be independently programmed with respect to each controller of the system.

SUMMARY OF THE INVENTION

Accordingly, it is an object of the present invention to provide a music playing data fetch circuit for a personal computer which overcomes the aforementioned and other problems encountered in the conventional art.

It is another object of the present invention to provide an improved music playing data fetch circuit for a personal computer which is capable of reducing the operational time of an operating system of a personal computer by fetching a serial playing data of a music playing program.

It is another object of the present invention to provide an improved music playing data fetch circuit for a personal computer which is capable of reducing a chip size by transmitting and receiving a midi data by using only a receiving channel of a universal type asynchronous transceiver.

It is another object of the present invention to provide an improved music playing data fetch circuit for a personal computer which is capable of improving a music playing operation using a CPU of a personal computer by using a 64-bit FIFO memory without using an interruption unit.

To achieve the above and others objects, there is provided a music playing data fetch circuit for a personal computer which includes a sound interface controller for receiving a serial playing data from a music playing program from a central processing unit (CPU) of a personal computer (PC), a midi interface controller for fetching a serial playing data from the sound interface controller and generating tone, waveform, etc. by enabling an interrupt request signal, and a buffer for buffering a data from the sound interface controller when the personal computer requests the data transmitted to the midi interface controller.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
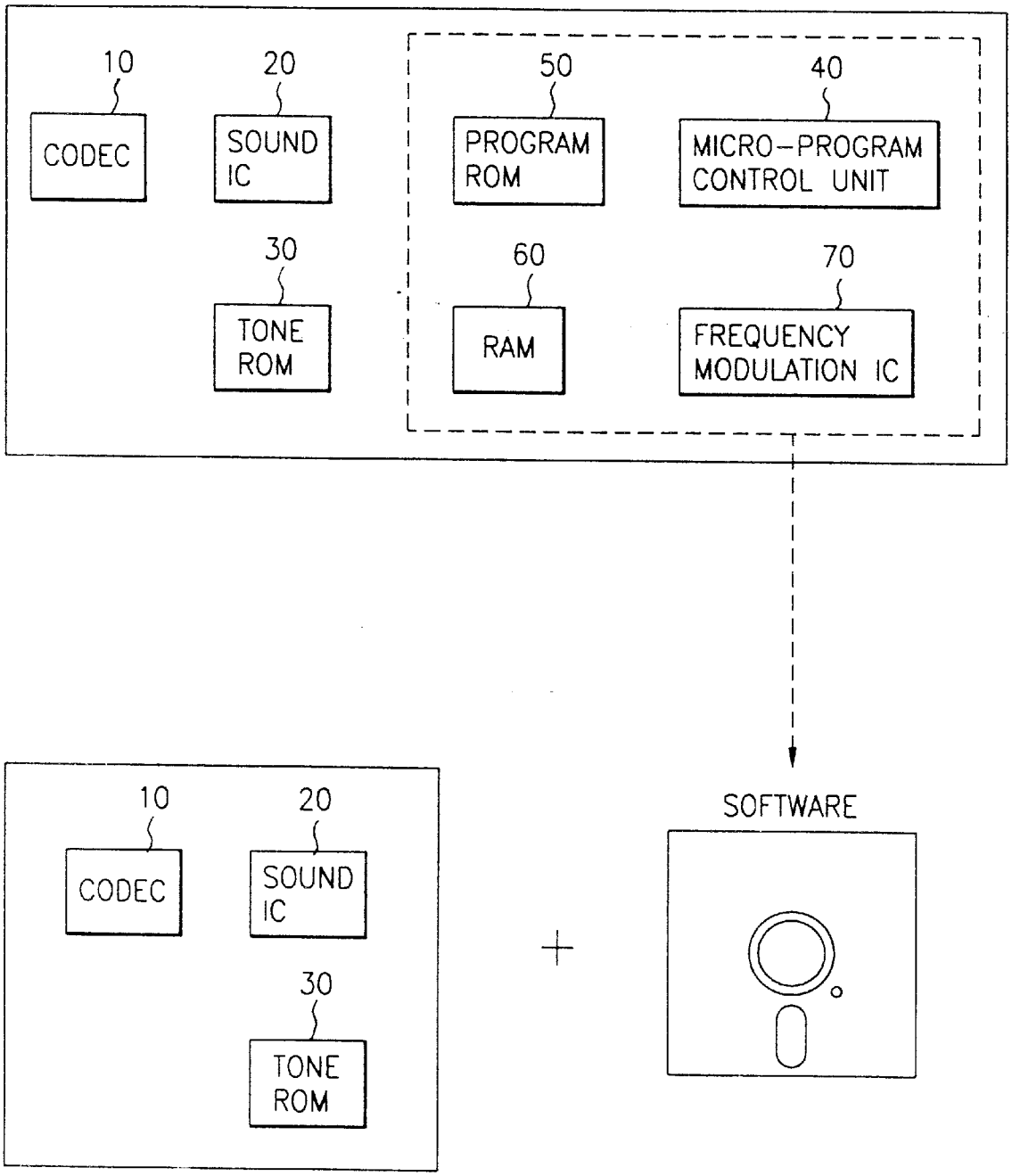
FIG. 1 CONVENTIONAL ART
FIG. 1 is a block diagram illustrating a conventional sound card circuit for a personal computer using a music playing program.
Figure 2:
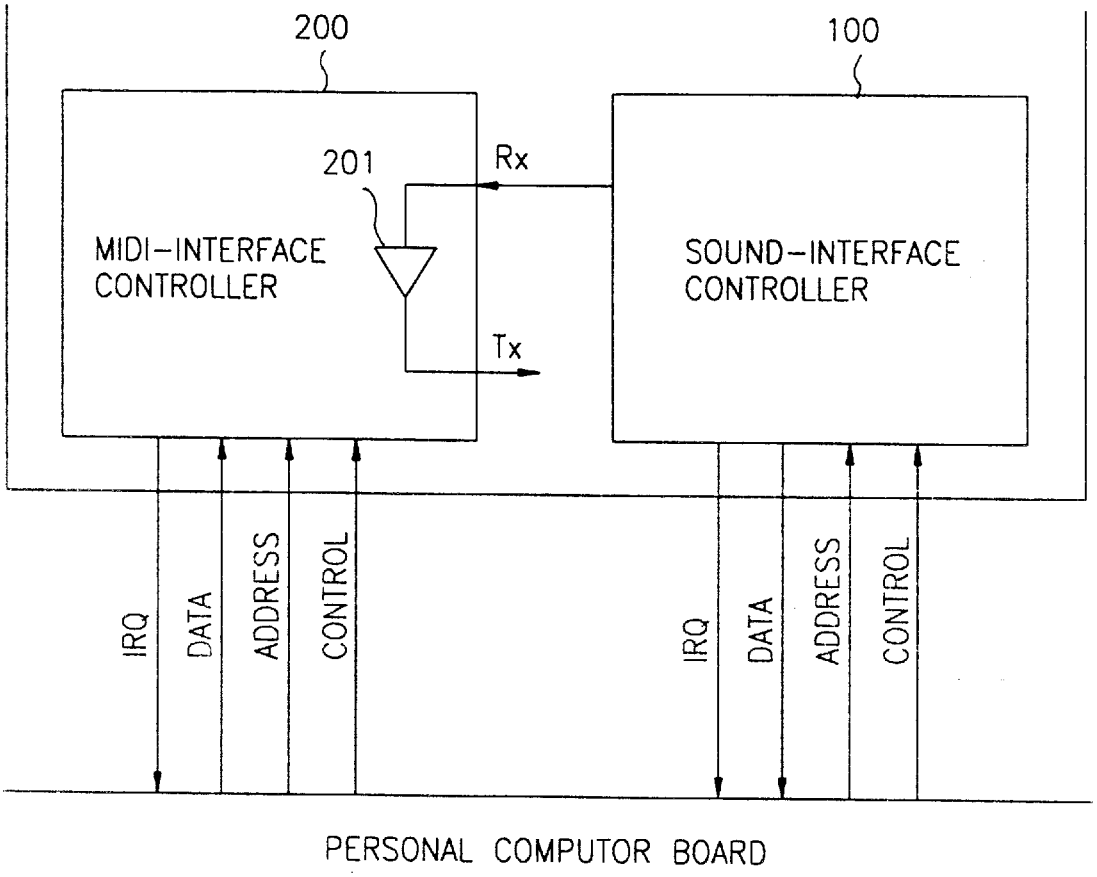
FIG. 2 is a block diagram illustrating a music playing data fetch circuit for a personal computer according to the present invention.
Figure 3:
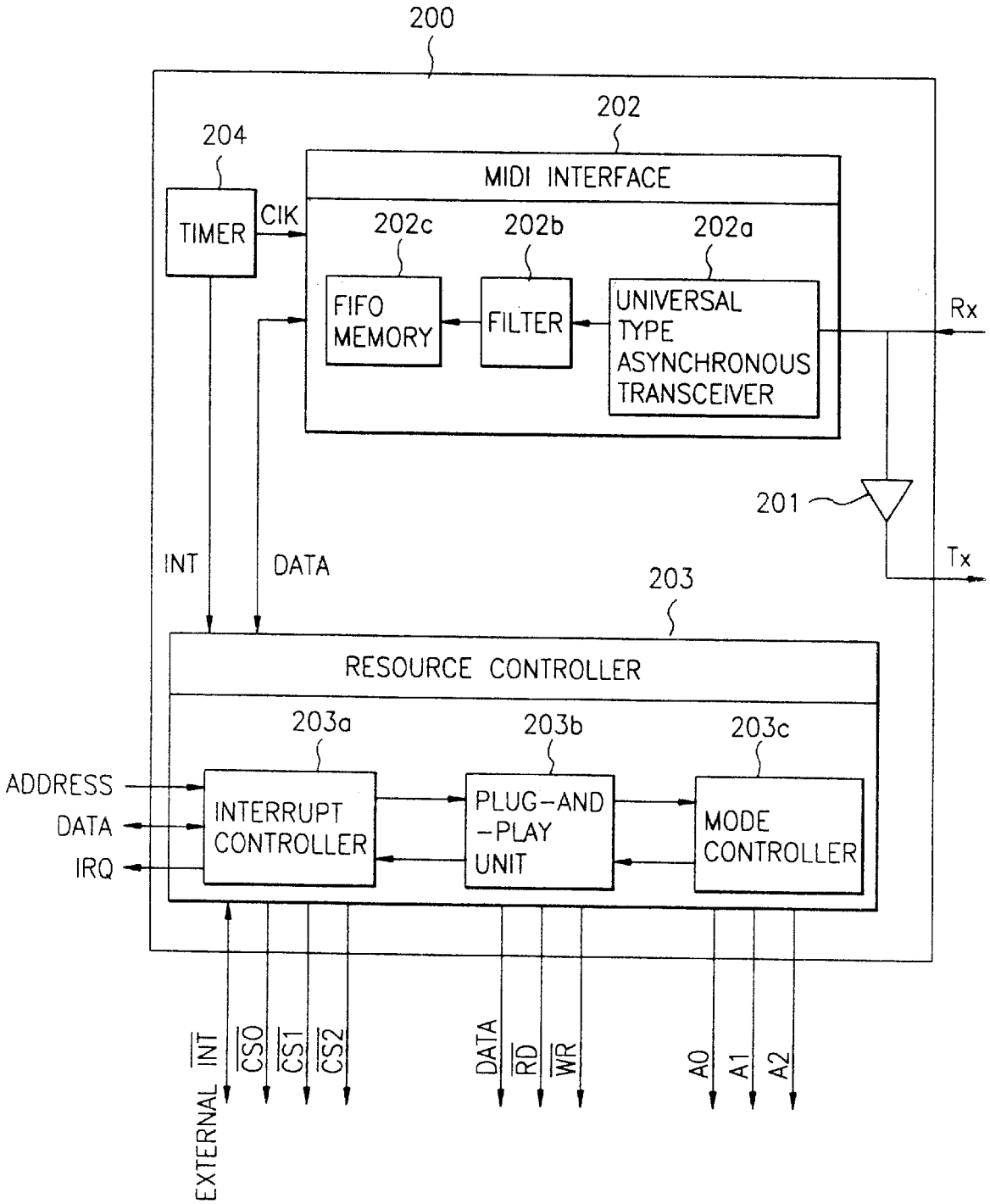
FIG. 3 is a detailed block diagram illustrating a midi interface controller in the circuit of FIG. 2 according to the present invention.

FIG. 2 illustrates a music playing data fetch circuit for a personal computer according to the present invention, and FIG. 3 illustrates a midi interface controller in the circuit of FIG. 2 according to the present invention.

As shown therein, the music playing data fetch circuit for a personal computer according to the present invention includes a sound interface controller 100 for receiving a serial playing data of a music playing program from a central processing unit (CPU) of a personal computer (PC), a midi (musical instrument device interface) controller 200 for fetching a serial playing data from the sound interface controller 100 and generating tones and forming wave forms by enabling an interrupt request signal, and a buffer 201 for buffering data from the sound interface controller 100 when a PC needs data from the midi interface controller 200.

As shown in FIG. 3, the midi interface controller 200 includes a midi interface unit 202 for serially receiving a serial playing data from the sound interface controller 100, a timer 204 for generating and outputting a Baud rate to the midi interface unit 202, controlling the transmission speed of the serial playing data, and generating an interior interrupt signal when an interior interrupt signal is generated by the timer 204, and a resource controller 203 for receiving and transmitting chip selection signals /CSO, /CS1, and /CS2, address signals A0, A1, and A2, a read signal /RD and a write signal /WR for receiving and transmitting data for communicating with the CPU of the PC in order to generate tone, wave forms, etc. which match with the serial playing data inputted through the midi interface unit 202 when an interior interrupt data is generated by the timer 204.

The operation and effects of the music playing data fetch circuit for a personal computer according to the present invention will now be explained with reference to the accompanying drawings.

When a serial playing data of a music playing program is inputted into the sound interface controller 100 from the CPU of the PC, the sound interface controller 100 transmits the serial playing data to the midi interface controller 200.

When the data is received through a receiving terminal Rx of the midi interface controller 200, the buffer 201 and the midi interface unit 202 receive the data, respectively.

Here, the buffer 201 is used for serially transmitting data to the sound interface controller 100 by connecting the receiving and transmitting terminals Rx and Tx to the interior portion of the midi interface controller 200, not to an outer portion of the board due to a fan-out problem.

In addition, the universal type asynchronous transceiver 202*a* of the midi interface unit 202, which received a serial playing data, outputs the data to the filter 202*b*.

The filter 202*b* filters and extracts a time code, an active sense signal, etc. for about 10 ms.

The extracted midi data are stored into the FIFO memory 202*c*.

The buffer 201 stores a received serial playing data, and the size of the same is 64-byte.

The timer 204 generates a Baud rate to the midi interface 202 in order to receive the base time and serial midi data of the sound.

Thereafter, an interrupt signal INT is generated in order to inform about a serial midi data to the resource controller 203.

Here, the Baud rate denotes the number of signals which are transmitted per second.

When the interrupt signal INT is generated from the timer 204, the interrupt controller 203*a* of the resource controller 203 recognizes a state that the serial midi data is inputted, and outputs a predetermined signal to the CPU of the PC in order to change sound level, tone, etc. When an interruption (/INT) externally occurs, the interrupt controller 203*a* outputs a signal so that the midi interface 202 is prepared to receive the data.

In addition, the mode controller 203*c* masks an interrupt request signal when there is not an external data inputted, or an event received, and an idle bit is set, or controls the sleep mode in which the timer 204 is turned off, or controls a wake-up mode in which the timer is turned on, and an interrupt request signal is enabled when the data is externally inputted, or an event is generated.

Finally, the plug-and-play unit 203*b* of the resource controller 203 is configured to set a port address or an interrupt request signal with respect to the chip.

As described above, a music playing data fetch circuit for a personal computer according to the present invention is directed to reducing the operational time of an operating system of the personal computer by controlling the fetch of the serial midi data of the music playing program based on the hardware, reducing the chip size by concurrently performing transmitting and receiving operations by using only a receiving channel of the universal type asynchronous transceiver UART of the midi interface controller, and serially outputting data by using a buffer without using an interrupt signal when a serial midi data is needed, whereby it is possible to enhance the performance of the system.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A music playing data fetch circuit, comprising:

a sound interface controller for receiving serial playing data from a music playing program from a central processing unit (CPU) of a personal computer (PC);

a midi (musical instrument device interface) interface controller for fetching the serial playing data from the sound interface controller and generating output signals by enabling an interrupt request signal; and a buffer for buffering data from the sound interface controller when the personal computer requests the data transmitted to the midi interface controller.

2. The circuit of claim 1, wherein said midi interface controller includes:

a midi interface unit for receiving and storing the serial playing data from the sound interface controller;

a timer for generating a Baud rate to the midi interface unit, controlling a transmission of speed of the serial playing data, and generating an interior interrupt signal when the serial playing data are inputted to the midi interface unit; and a resource controller for transmitting and receiving data to and from the CPU of the personal computer for generating output signals matching with the serial playing data inputted through the midi interface unit when the interior interrupt signal is generated by the timer.

3. The circuit of claim 1, wherein said midi interface controller includes a buffer which receives and stores the serial playing data from a receiving terminal and serially transmits the serial playing data when the serial playing data are requested from a predetermined element.

4. The circuit of claim 2, wherein said midi interface unit includes:

a universal type asynchronous transceiver for directly transmitting the serial playing data to a filter;

the filter for filtering the serial playing data from the universal type asynchronous transceiver and obtaining predetermined information; and a memory for sequentially storing the information from the filter and sequentially outputting the stored information a tion in the sequence of the storage.

5. The circuit of claim 2, wherein said resource controller includes:

an interrupt controller for controlling the interior interrupt signal generated from the timer and an externally inputted interrupt signal, and controlling a transmitting and receiving of the serial playing data;

a plug-and-play unit for automatically controlling a port address signal and the interrupt request signal; and a mode controller for controlling a sleep mode in which the timer is turned off and a wake-up mode in which the timer is turned on.

6. The circuit of claim 4, wherein said memory of said midi interface unit is a FIFO memory.

7. The circuit of claim 5, wherein said mode controller controls the sleep mode by disabling the interrupt request signal when no data is externally received and an idle bit is set.

8. The circuit of claim 5, wherein said mode controller controls the wake-up mode by enabling the interrupt request signal when data is externally received and an event is inputted.

9. The circuit of claim 2, wherein the resource controller generates address signals, chip select signals, and read and write signals for receiving and transmitting the data to and from the CPU.

* * * * *